US007515859B2

(12) United States Patent
Rohde et al.

(10) Patent No.: US 7,515,859 B2
(45) Date of Patent: Apr. 7, 2009

(54) POWER SPLITTER FOR A MICROWAVE FUSER OF A REPRODUCTION APPARATUS

(75) Inventors: Domingo Rohde, Kiel (DE); Frank-Michael Morgenweck, Kiel (DE); José Manuel Catalá-Civera, Valencia (ES)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/739,259

(22) Filed: Apr. 24, 2007

(65) Prior Publication Data

US 2008/0267678 A1 Oct. 30, 2008

(51) Int. Cl.
*G03G 15/20* (2006.01)

(52) U.S. Cl. ..... 399/336

(58) Field of Classification Search ..... 219/690–697; 399/336

See application file for complete search history.

(56) References Cited

U.S. PATENT DOCUMENTS

| | | | |
|---|---|---|---|
| 2,909,635 | A | 10/1959 | Haagensen |
| 5,536,921 | A | 7/1996 | Hedrick et al. |
| 6,114,677 | A | 9/2000 | Idomoto et al. |
| 7,022,954 | B2 | 4/2006 | Behnke et al. |
| 2003/0205576 | A1 | 11/2003 | Drozd et al. |
| 2004/0226942 | A1 | 11/2004 | Behnke et al. |

FOREIGN PATENT DOCUMENTS

| | | | |
|---|---|---|---|
| DE | 3633425 | | 4/1988 |
| EP | 0 632 678 | | 1/1995 |
| JP | 56080077 A | * | 7/1981 |
| JP | 57124379 A | * | 8/1982 |

* cited by examiner

*Primary Examiner*—Ryan Gleitz
(74) *Attorney, Agent, or Firm*—Lawrence P. Kessler

(57) ABSTRACT

A microwave fuser device for heating printing matter in a reproduction apparatus with microwave energy from a suitable microwave source. The microwave fuser device supplies microwave energy through the bottom of a multi-channel resonator including a gap to enable transport of printing matter therethrough. The device includes a power splitter having plural channels for dividing microwave energy from the microwave source between the channels of the multi-channel resonator. The power splitter has a mechanism to provide variable geometry of its plural channels, whereby the effective width of microwave energy from the resonator of the microwave fuser device can be matched to the width of such printed matter having an image fused thereto substantially preventing undesirable high loss of energy and low yield.

5 Claims, 5 Drawing Sheets

POWER SPLITTER FOR A MICROWAVE FUSER OF A REPRODUCTION APPARATUS

FIELD OF THE INVENTION

This invention relates in general to microwave fuser for a reproduction apparatus, and more particularly to a variable power splitter for a microwave fuser of a reproduction apparatus.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles (dry ink) are attracted to the latent image charge pattern to develop such image on the dielectric support member. A printed matter, such as a sheet of paper, transparency or other medium, is then brought into contact with the dielectric support member, and an electric field applied to transfer the dry ink developed image to the printed matter from the dielectric support member. After transfer, the printed matter bearing the transferred image is transported away from the dielectric support member, and the image is fixed (fused) to the printed matter by heat and pressure to form a permanent reproduction thereon.

Typically the toner is fused by a fuser apparatus where a printed matter is transported through a pair of heated rollers. This fuser apparatus requires a separation agent, typically silicone oil, applied to the heated rollers so as to prevent the toner image on a printed matter from adhering to the heated rollers. Such separation agent can result in defects in the print image, such as smudges or streaks, or can have an adverse effect on the fuser apparatus or other devices in the reproduction apparatus. Furthermore, after a period of time, the fuser heated rollers show abrasion and wear. The negative properties of fusing by heat rollers can be avoided by non-contact fusing, such as by microwave heating of the printed matter substrate. Examples of typical microwave fusing apparatus are shown in U.S. Pat. No. 5,536,921, issued on Jul. 16, 1996, in the names of Hedrick et al.; and U.S. Pat. No. 7,022,954, issued on Nov. 8, 2004, in the names of Behnke et al.

SUMMARY OF THE INVENTION

In view of the above, this invention is directed to a microwave fuser device for heating printing matter in a reproduction apparatus with microwave energy from a suitable microwave source. The microwave fuser device supplies microwave energy through the bottom of a multi-channel resonator including a gap to enable transport of printing matter therethrough. The microwave fuser device includes a power splitter having plural channels for dividing microwave energy from the microwave source between the channels of the multi-channel resonator. The power splitter has a mechanism to provide variable geometry of its plural channels, whereby the effective width of microwave energy from the resonator of the microwave fuser device can be matched to the width of such printed matter having an image fused thereto substantially preventing undesirable high loss of energy and low yield.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
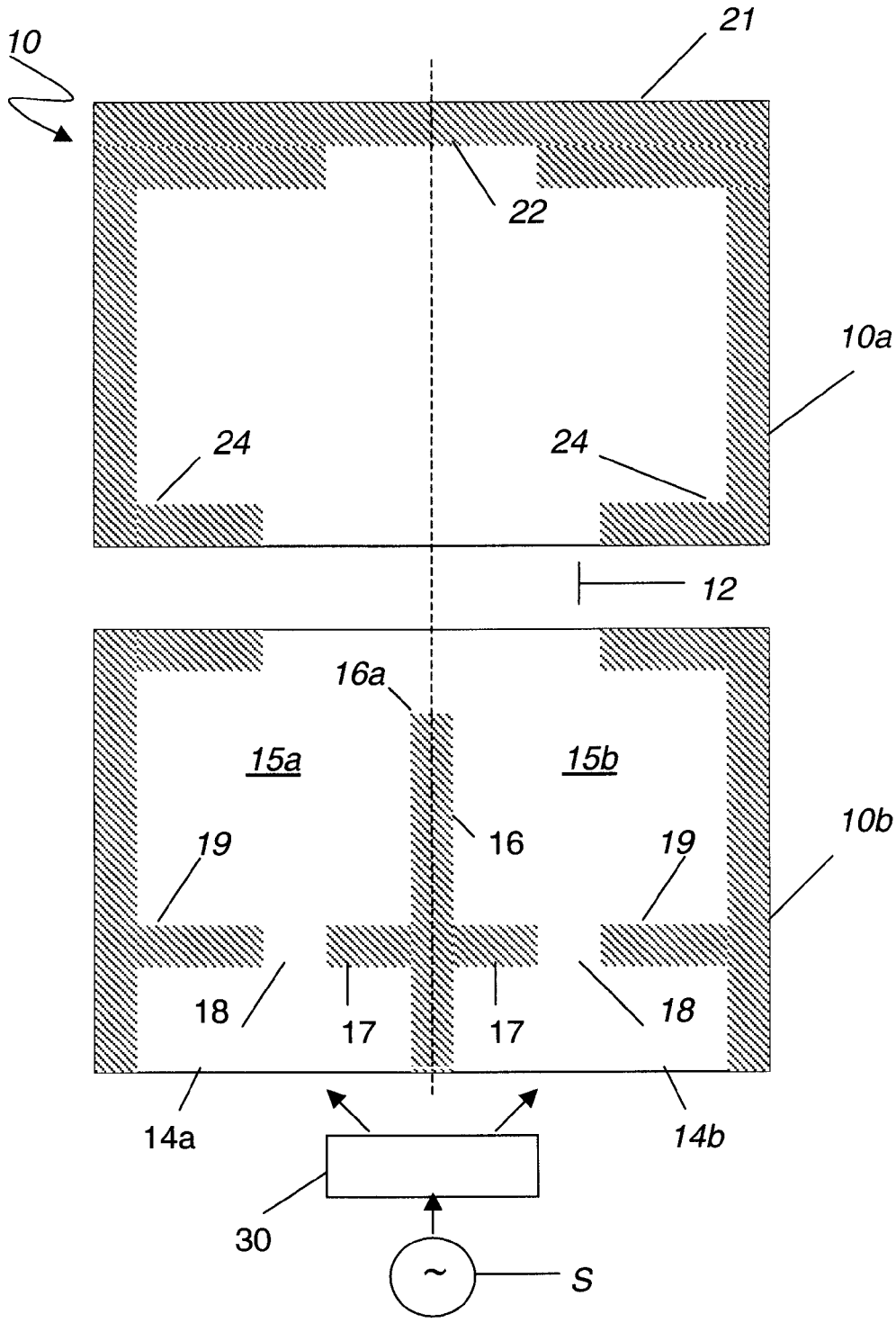
FIG. 1 (PRIOR ART)
FIG. 1 is an end elevational view, in cross-section, of a prior art resonator for a microwave fuser device, taken perpendicular to the printed matter transport path.

Referring now to the accompanying drawings, FIG. 1 shows the prior art microwave fusing apparatus fully described in aforementioned U.S. Pat. No. 7,022,954, issued Nov. 8, 2004, in the names of Behnke et al. By this exemplary microwave fuser device, it is possible to optimize the temperature profile setting for effecting fusing. It is especially desirable to influence the profile of the electric field transversally of the printing matter transport direction (i.e., into the plane of FIG. 1). The resonator, designated by the numeral 10, for a microwave fuser device is divided into two parts, an upper part 10*a* and a lower part 10*b*, with a gap 12 defined between them, through which printed matter is transported (into the plane of FIG. 1) for heating.

Microwave energy is fed to the resonator 10 from below through two openings 14*a*, 14*b* by a microwave source S. The microwave source S may be connected to both openings 14*a*, 14*b*, and the microwave energy is divided by a power splitter 30 into two cavity areas 15*a*, 15*b* of the resonator 10, in which the cavity area located on the side of the gap 12, as seen from the microwave entry, is divided, at least partly, with at least one partition wall portion 16 and is perpendicular to the printed matter transport direction. The partition wall portion 16 has, at least on one side, a protruding shelf 17 extending in parallel with the printed matter transport, which preferably defines a part of a free-passage shutter 19 in the shutter opening 18 at the microwave entry. The plane defined by the elements 19, 18, and 17 represents a part having an opening (shutter), with the opening (shutter) that is held in place. The part under this plane belongs to the power splitter. The distance from the shelf 17 and from the shutter 19 to an edge 16*a* of the partition wall portion 16 facing toward the gap 12 can be preset or adjustable.

It should be noted that the end face of the resonator remote from the microwave entry side is closed with a cavity cover 21. As can be seen, the cover 21 has a recess 22 extending in parallel with the printed matter transport direction. The recess 22 is made as a groove in the cover 211, extending from one cavity wall 23*a* to the other cavity wall 23*b*. The depth of the recess 22 is preset or adjustable, just as the width of the border or borders of the recess 22, transversally of the printed matter transport direction.

The cavity area of the resonator part 10*a*, located on the side opposite to the gap 12 as seen from the microwave entry, has at least one flange 24 protruding inwardly into the cavity. The flanges 24 define a limiting surface portion for the gap 12 and/or cavity area of the resonator part 10*a* located on the side of the gap 12 as seen from the microwave entry. The flanges 24 have a dimension that is preset or adjustable.

Figure 2:
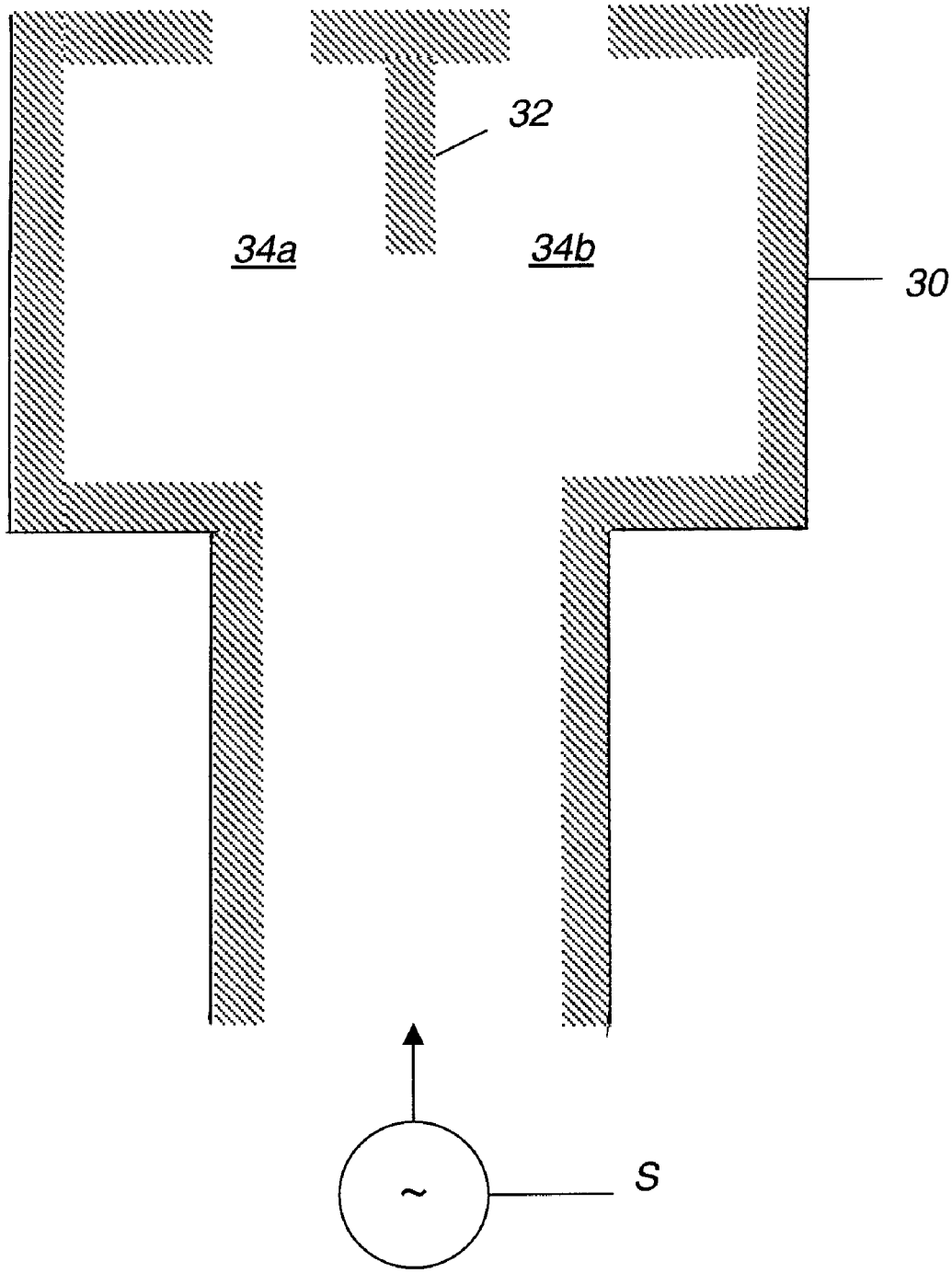
FIG. 2 (PRIOR ART)
FIG. 2 is an end elevational view, in cross-section, of a prior art power splitter, for a microwave fuser device.

As noted above, in the prior art a microwave source S supplies microwave energy through the bottom of the resonator 10 via a power splitter 30 and two openings 14*a*, 14*b* to respective halves of the resonator 10 (see FIG. 2). FIG. 2 shows a cross-sectional view through a typical power splitter 30 for the resonator 10 according to FIG. 1. As with the showing of FIG. 1, FIG. 2 is perpendicular to the transport direction (into the plane of FIG. 2). The microwave source S is located below the power splitter 30, and the resonator 10 is mounted above the power splitter. The power splitter 30 has an internal wall 32 that is located within the power splitter to define split chambers 34*a*, 34*b* for microwave energy directed to the openings 14*a*, 14*b* of the resonator shown in FIG. 1. As described in U.S. Pat. No. 7,022,954, the heating profile perpendicular to the transport direction of a printed matter can be influenced by selection of the geometric parameters of the resonator 10. Such profile cannot be modified later during the fusing process. Thus the fusing energy has to be supplied along the full width of the heater even in case of printed matters having smaller width. Accordingly, the result is a high loss of energy and low yield.

Figure 3:
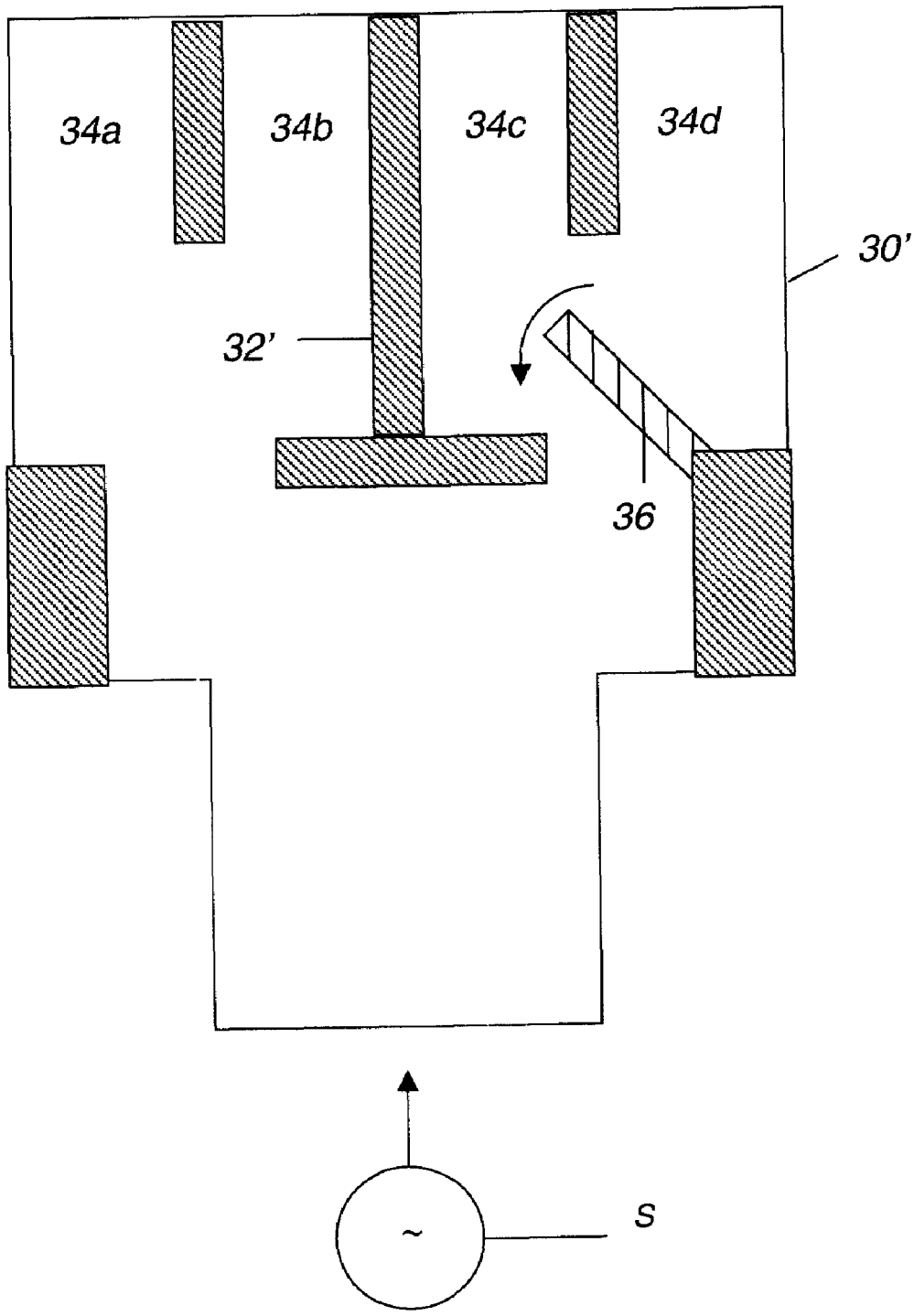
FIG. 3 is an end elevational view, in cross-section, of an embodiment of the power splitter, for a microwave fuser device, according to this invention, having a movable member to close off unused channels.

According to this invention, the effective width of microwave energy from the resonator of a microwave fuser apparatus can be matched to the width of printed matter having an image fused thereto by using variable power splitters. Generally, this is accomplished by providing a variable geometry arrangement for the power splitter. In a first preferred embodiment of a power splitter, designated by the numeral 30' in FIG. 3, according to this invention, at least one movable flat member 36 is incorporated into the power splitter 30'. The flat member 36 can be selectively moved by any well known electrical or mechanical mechanism (or any combination thereof) into operative association with an internal wall 32' to close certain of the channels 34*a*'-34*d*' from the outside inward. The channels being closed correspond to areas beyond the width of the printed matter, while the channels that remain open correspond to the width of the printed matter. Thus, the microwave energy from the source S will be effectively controlled by the power splitter 30' to be applied through the resonator 10 only in the area of the printed matter, thereby substantially preventing undesirable high loss of energy and low yield. Of course, other suitable arrangements for flat members for blocking channels may be utilized within the principles of this invention.

Figure 4:
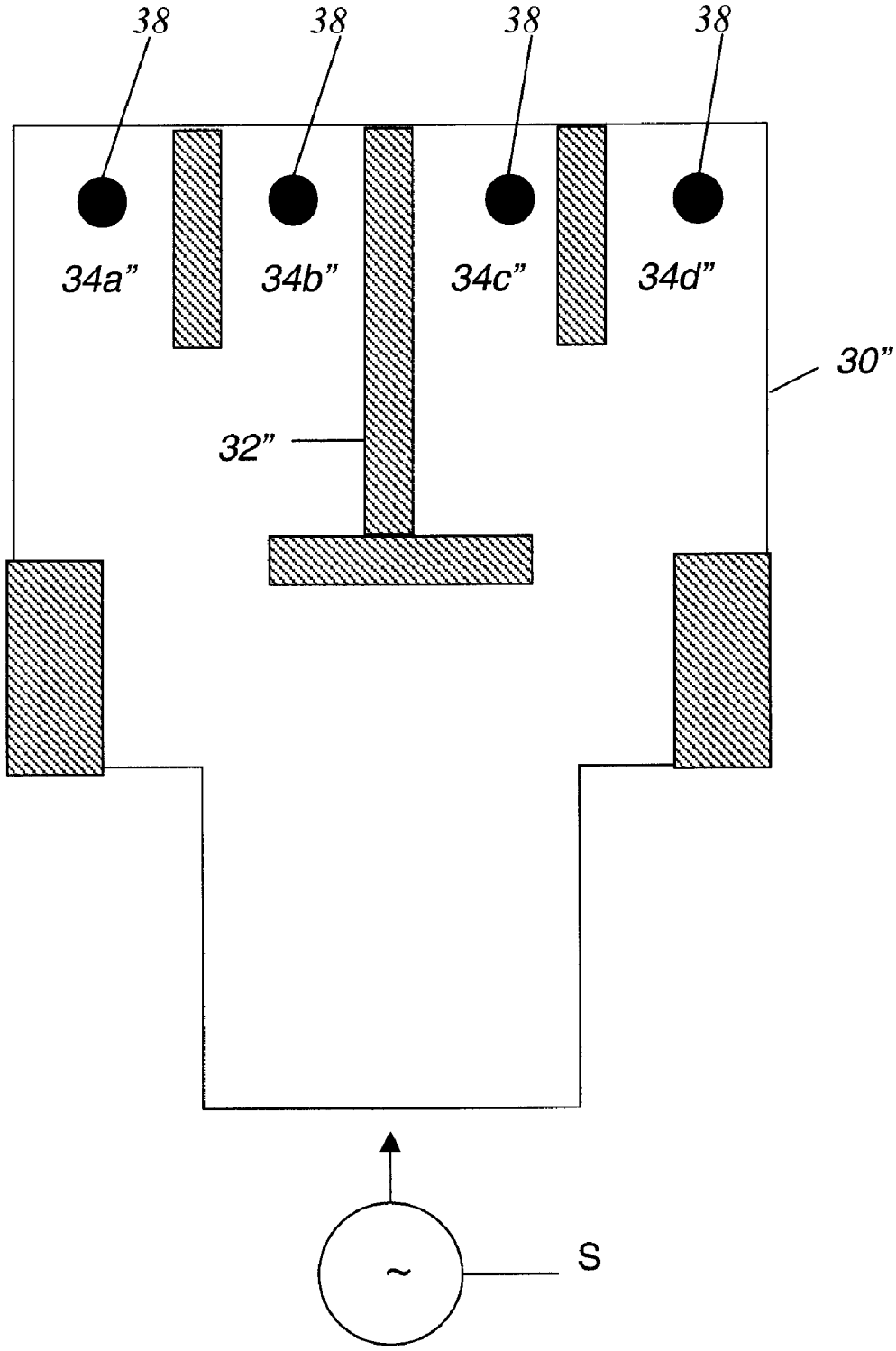
FIG. 4 is an end elevational view, in cross-section, of another alternate embodiment of the power splitter, for a microwave fuser, according to this invention, having a tunable element to close off unused channels.

In another preferred embodiment for the power splitter, designated by the numeral 30" in FIG. 4, according to this invention, the individual channels 34*a*"-34*d*" of the power splitter 30" may contain respective tuning elements 38, such as a dielectric load or metal rod that can be selectively activated to worsens impedance matching of such channel, or makes it impossible for microwave waves to pass through such channel.

Figure 5:
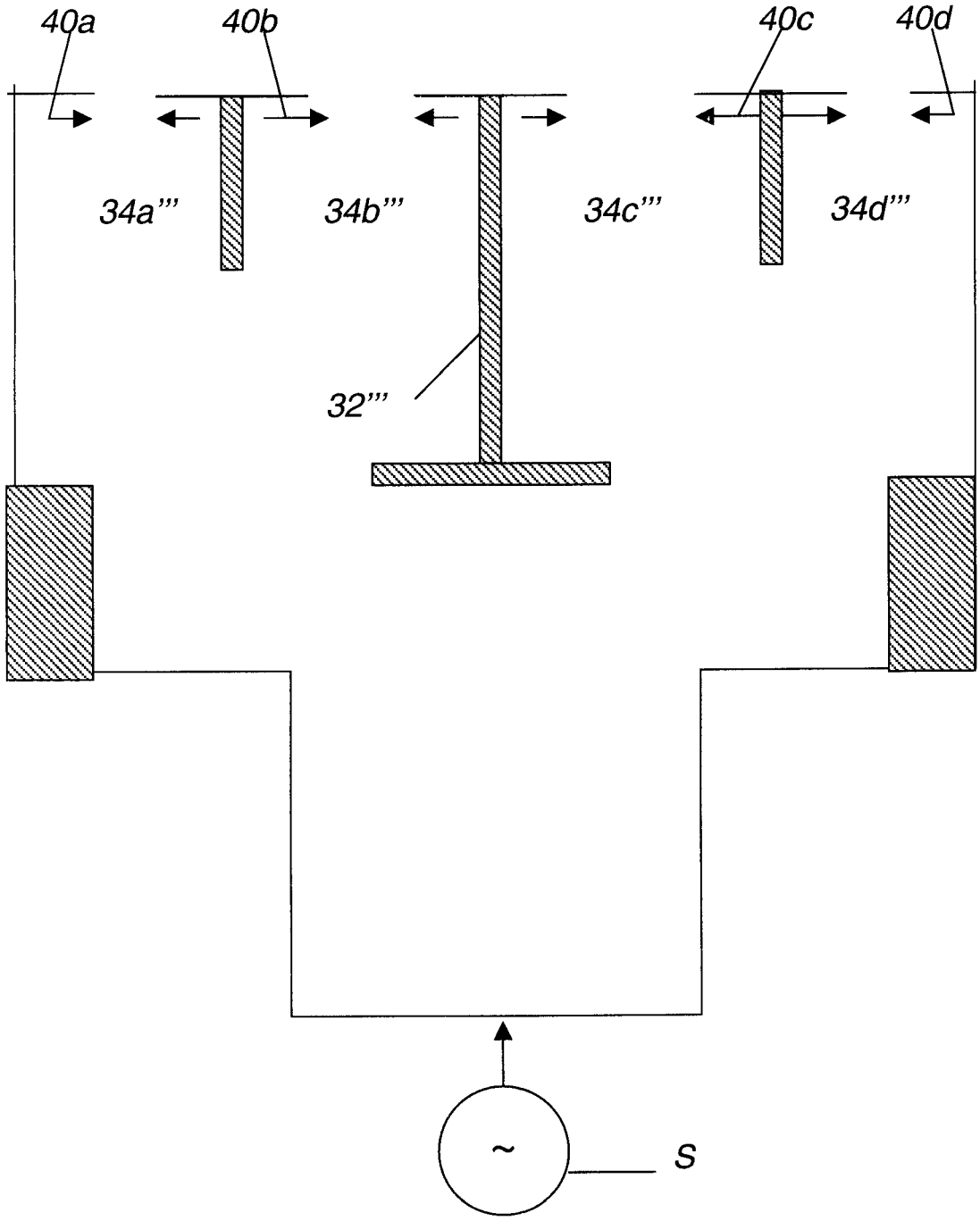
FIG. 5 is an end elevational view, in cross-section, of a still further alternate embodiment of the power splitter, for a microwave fuser, according to this invention, having a closable slit to close off unused channels.

In still another preferred embodiment for the power splitter, designated by the numeral 30'" in FIG. 5, according to this invention, the individual channels 34*a*'"-34*d*'" of the power splitter 30'" may contain respective closable slits 40*a*-40*d*.

In all of the described preferred embodiments, the microwave energy of the blocked channels is at least partially returned into the non-blocked (open) channels and maybe used for heating there. Depending upon complexity and execution of the power splitter, it is anticipated that additional mechanisms maybe necessary to make sure of an even heating by the resonator 10.

The invention has been described in detail with particular reference to certain preferred embodiments thereof, but it will be understood that variations and modifications can be effected within the spirit and scope of the invention.

What is claimed is:

1. A microwave fuser device for heating printing matter in a reproduction apparatus with microwave energy from a suitable microwave source, said microwave fuser device supplying microwave energy through a multi-channel resonator including a gap to enable transport of printing matter therethrough, said device comprising:

a power splitter having plural channels for dividing microwave energy from said microwave source between the channels of said multi-channel resonator, said power splitter including at least one movable flat member selectively movable to close certain of said channels of said power splitter to provide variable geometry of its plural channels, whereby the effective width of microwave energy from the resonator of said device for heating printing matter can be matched to the width of such printed matter having an image fused thereto substantially preventing undesirable high loss of energy and low yield.

2. The microwave fuser device for heating printing matter in a reproduction apparatus according to claim 1, wherein said at least one movable flat member is selectively movable into operative association with an internal wall of said power splitter to close certain of said power splitter channels from the outside inward, whereby said channels being closed correspond to areas beyond the width of printed matter, while said channels that remain open correspond to the width of printed matter.

3. A microwave fuser device for heating printing matter in a reproduction apparatus with microwave energy from a suitable microwave source, said microwave fuser device supplying microwave energy through a multi-channel resonator including a gap to enable transport of printing matter therethrough, said device comprising:

a power splitter having plural channels for dividing microwave energy from said microwave source between the channels of said multi-channel resonator, said power splitter including a mechanism to provide variable geometry of its plural channels, whereby the effective width of microwave energy from the resonator of said device for heating printing matter can be matched to the width of such printed matter having an image fused thereto substantially preventing undesirable high loss of energy and low yield, wherein the individual ones of said channels of said power splitter contain respective tuning elements, which can be selectively activated to make it impossible for microwave waves to pass through such channel with an activated tuning element.

4. The microwave fuser device for heating printing matter in a reproduction apparatus according to claim 3 wherein said respective tuning elements include a dielectric load or metal rod that can be selectively activated to worsen impedance matching.

5. A microwave fuser device for heating printing matter in a reproduction apparatus with microwave energy from a suitable microwave source, said microwave fuser device supplying microwave energy through a multi-channel resonator including a gap to enable transport of printing matter therethrough, said device comprising:

a power splitter having plural channels for dividing microwave energy from said microwave source between the channels of said multi-channel resonator, said power splitter including a mechanism to provide variable geometry of its plural channels, whereby the effective width of microwave energy from the resonator of said device for heating printing matter can be matched to the width of such printed matter having an image fused thereto substantially preventing undesirable high loss of energy and low yield, wherein individual ones of said channels of said power splitter contain respective closable slits.

* * * * *